US007206422B2

(12) United States Patent
Akens et al.

(10) Patent No.: US 7,206,422 B2
(45) Date of Patent: Apr. 17, 2007

(54) TRANSDUCER ASSEMBLY APPARATUS

(75) Inventors: Jody H. Akens, Weston, FL (US); Jeffrey W. Ashton, Plantation, FL (US); Jorge L. Garcia, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 539 days.

(21) Appl. No.: 10/374,648

(22) Filed: Feb. 26, 2003

(65) Prior Publication Data

US 2004/0165739 A1 Aug. 26, 2004

(51) Int. Cl.
*H04R 25/00* (2006.01)

(52) U.S. Cl. ..... 381/189; 381/345; 381/392; 381/386

(58) Field of Classification Search ..... 381/162, 381/345, 353, 361, 368, 386, 392, 395, 189; 181/148, 171, 172, 198, 199; 455/128, 347, 455/90.3

See application file for complete search history.

(56) References Cited

U.S. PATENT DOCUMENTS 4,719,322 A * 1/1988 Guzik et al. ..... 200/5 A
5,068,917 A * 11/1991 Sugiyama et al. ..... 455/90.3
5,739,481 A * 4/1998 Baumhauer et al. ..... 181/148
7,120,261 B1 * 10/2006 Turnbull et al. ..... 381/86

* cited by examiner

*Primary Examiner*—Curtis Kuntz
*Assistant Examiner*—Tuan Duc Nguyen
(74) *Attorney, Agent, or Firm*—Barbara R. Doutre

(57) ABSTRACT

An assembly (100) for acoustic sealing of a transducer (104) in a communication device is provided. The assembly (100) allows for assembly along one axis (112) and acoustical sealing along another axis (115). The assembly (100) allows for another transducer (106) to be acoustically sealed on a different plane than that of the first transducer (104). Through the use of a compliant member (204) and rigid member (108) coupled to the transducer (104) a floating seal is formed between the chassis (102) and the housing (103) of the communication device (100).

6 Claims, 2 Drawing Sheets

TRANSDUCER ASSEMBLY APPARATUS

TECHNICAL FIELD

This invention relates in general to methods and apparatus for acoustically sealing acoustic transducers in electrical and electronic devices, and more particularly to acoustically sealing transducers in a first axis where the transducer assembly is assembled into the device along a different axis.

BACKGROUND

A variety of housing form factors are used in communication devices. Two popular form factors in use in today's radios are the tub-style form factor and the cup-style form factor. Typically, tub-style housings are assembled front to back while cup-style housings are assembled in a sleeve type fashion with one piece sliding into another. Tub-style housings usually require larger interfaces than cup-style housings. The smaller interfaces used in cup-style housings provide a full enclosure to the device. The full enclosure of the cup-style housing provides a preferred form factor for ruggedness but provides limited access for assembly.

In both tub and cup-style housings, a good acoustic seal is needed between the speaker and front housing to avoid leaks and maintain audio integrity. The cup-style housing presents several challenges when it comes to acoustic porting, because it needs to be assembled in one axis but provide an acoustic seal in another axis. For example, sliding a silicone rubber seal (often used to improve the acoustic and environmental seal between the speaker and housing) down the inside front housing may cause damage by folding the seal, lifting already present adhesives. Furthermore, the limited access of a cup-style housing makes the use of springs, clips, and screws for mounting a transducer to the front housing highly impractical.

Accordingly, there is a need for an improved acoustic seal assembly. In particular, an acoustic seal that would facilitate cup-style housing assembly would be highly beneficial.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
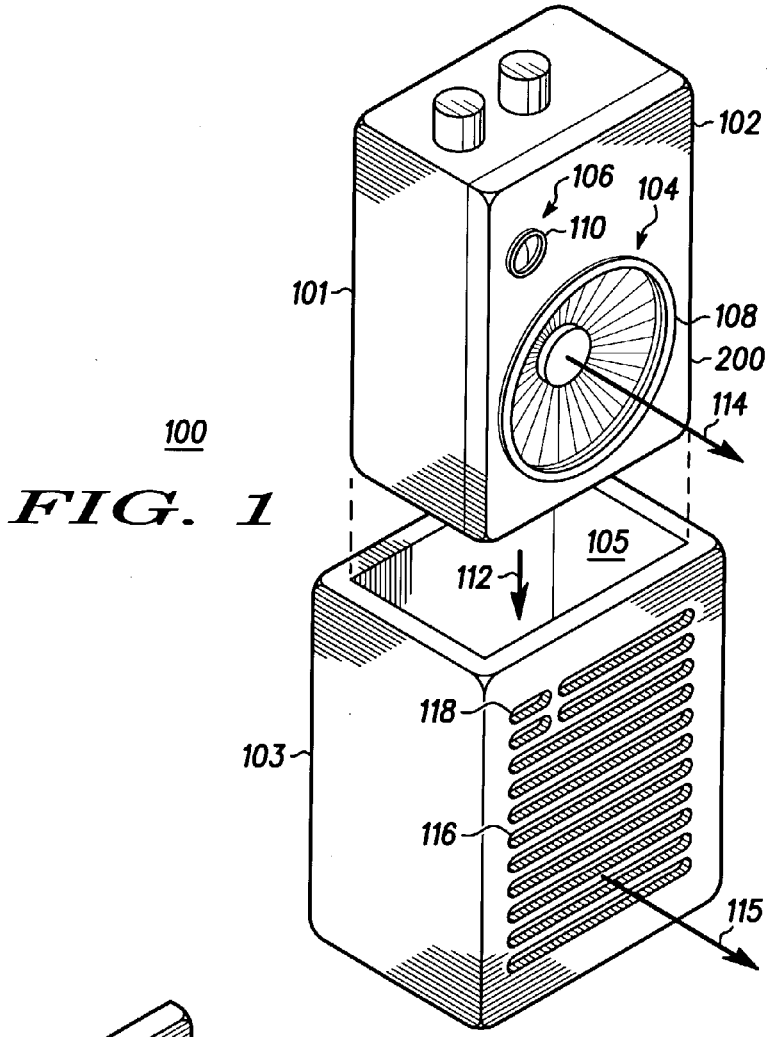
FIG. 1 shows an exploded view of a radio assembly having at least one acoustically sealed transducer in accordance with the invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, there is shown an exploded view of a radio assembly 100 having at least one acoustically sealed transducer, in accordance with the invention. The radio assembly 100 comprises a radio sub-assembly 101 and a transducer sub-assembly which will simply be referred to as transducer assembly 200. Transducer assembly 200 includes a chassis 102 for supporting or retaining at least one acoustic transducer assembly for forming an acoustic seal with a radio housing 103, which can be a cup or sleeve-style housing. The housing 103 has an opening 105 through which sub-assemblies are inserted. By cup-style it is meant a housing substantially in the shape of a cup. A cup-style housing has a bottom having a perimeter, with a wall or walls extending upwards along the perimeter to an opening at the top of the housing. However, it is not necessary for the housing to have a bottom, and the housing may be substantially sleeve-like. It is further contemplated that the housing 103 may be of the more conventional tub-style, but which has rails on which the chassis is slid into position within the housing. The chassis 102 is fabricated of a rigid material. In the preferred embodiment of the invention, the chassis is a metal or metalized plastic member to act as an electromagnetic shield.

Typically a radio includes both a first acoustic transducer 104, such as a speaker, and a second acoustic transducer 106, such as microphone. As is well known, the speaker converts electrical signals to acoustic waves to be heard by a user of the radio, and the microphone converts acoustic waves to electrical signals.

The transducer sub-assembly 200 slides into the housing 103 along an assembly axis 112, and when fully inserted into the housing the transducer 104 aligns with an audio grill 116 through which acoustic waves pass. Thus, the acoustic waves pass along a second axis 115 substantially perpendicular to the first axis 112. The second axis 115 aligns with the seal axis 114, which is the axis of compression for forming an acoustic seal.

It is contemplated that there may be provided a first and second audio grill 116, 118, one corresponding to each of the transducers 104, 106. The housing can be fabricated from a variety of materials, and in the preferred embodiment it is fabricated of polycarbonate plastic. Disposed around at least one of the acoustic transducers, and preferably both, is a substantially rigid member 108 which acts as a seal member. As the transducer sub-assembly is inserted into the housing 103, the seal member 108 slides along a wall of the housing and forms an acoustic seal around the transducer against the inside of the housing. To eliminate the problem of the seal member rolling or otherwise making insertion assembly difficult, according to the invention, the seal member is fabricated from a material that has a relatively low coefficient of friction against the housing material. Whereas a rubber or silicone seal member would have a coefficient of friction approaching, or even exceeding 1.0, the seal member of the invention has a coefficient of friction that is less than 0.5, and preferably less than 0.4. The seal member may be fabricated of the same material as the housing, and is preferably a glass-filled polycarbonate material. The use of glass-filled polycarbonate makes the seal member more rigid compared to plain polycarbonate. The low coefficient of friction between the seal member 108 and the housing 103 allows relatively easy insertion of the transducer sub-assembly 200 into the housing 103 while still providing an effective acoustic seal. Therefore the seal member 108 is shaped in correspondence with the shape of the inside of the housing where it forms the acoustic seal. For example, the seal member 108 can be formed of a substantially rigid ring having a chamfered surface to provide an effective seal. The assembly of FIG. 1 formed in accordance with the present invention provides for acoustical porting of a transducer by providing a housing having an opening for receiving the subassembly wherein the sub-assembly slidably inserts into the opening of the housing such that the chassis, the substantially rigid member, and the at least one compliant member compressibly align and seal about the transducer.

Figure 2:
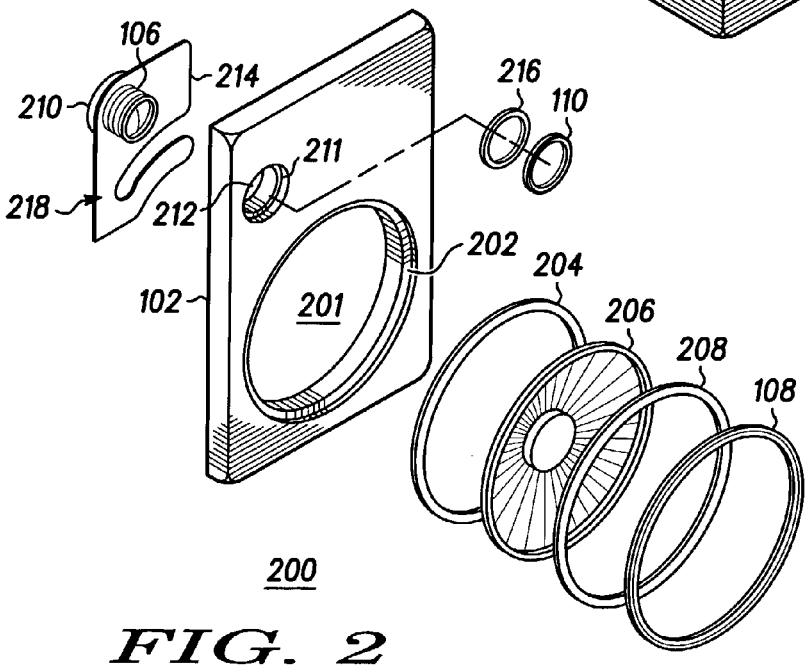
FIG. 2 shows an exploded view of a transducer assembly in accordance with the invention.

Referring now to FIG. 2, there is shown an exploded view of the transducer assembly 200 in accordance with the invention. The chassis 102 includes apertures 201 and 212 formed therein, which support or hold the acoustic transducers 104, 106. To hold the speaker 104, for example, the chassis has a support ledge 202 formed around the aperture 201. To be disposed on the support ledge 202 is a first compliant member, here shown as compliant ring 204. The first compliant ring 204 compressibly supports the speaker basket 206, which holds the speaker components. On top of the speaker basket 206 there may be disposed another portion of compliant material, such as a second compliant ring 208 which compressibly supports the seal member 108. While in the preferred embodiment the invention uses the first and second compliant rings 204, 208, it is contemplated that a single compliant portion may be used. Furthermore, it is contemplated that any of the compliant portions may be comprised of a ring, or, alternatively, smaller portions of compliant segments distributed around the periphery of the speaker basket 206. In fact, for the preferred embodiment of the invention, the microphone seal uses a single compliant portion in the form of a compliant ring 216. The microphone 106 is encapsulated in a compliant boot 210, and for mounting in the aperture 212 of the chassis 102. The compliant ring 216 sits on a support ledge 211, and a substantially rigid member which acts as a seal member 110 sits on top of the compliant ring 216. To retain these components in place, compliant portions may be operatively coupled to the chassis 102 or speaker basket 206, such as by adhesive, and the seal members may be operatively coupled to the compliant portions in a similar manner. The use of a compliant member minimizes vibration between transducer and chassis.

The transducer assemblies of the present invention may further comprise a flexible circuit board 214 which is electrically connected to the first and second transducers, shown here speaker 104 and microphone 106, for passing electrical signals to and from the transducers, as needed. The flexible circuit 214, in the preferred embodiment, electrically connects with the audio processing circuitry of the radio. Furthermore, in the preferred embodiment, the microphone is a surface mountable device that is mounted on the flexible circuit board for easy assembly into the chassis 102. In the preferred embodiment, the microphone transducer 106, flexible circuit board 214, and speaker transducer 104 are pre-assembled into the transducer sub-assembly 200, and assembled into the chassis at the same time during manufacture. To facilitate assembly and relieve strain on the flexible circuit board the board 214 is preferably designed with a strain relief feature 218.

Figure 3:
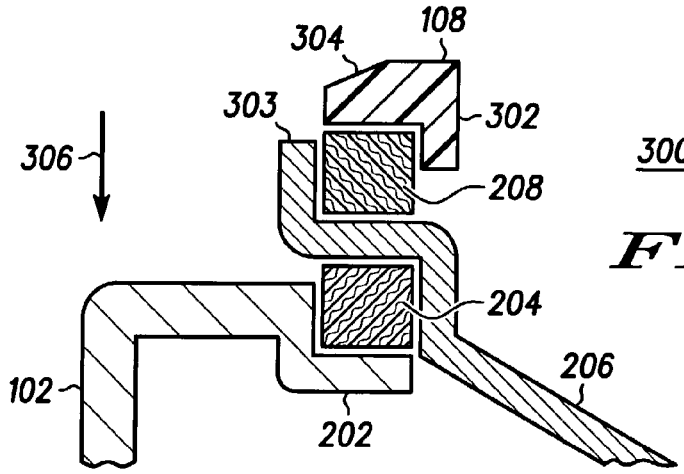
FIG. 3 shows a side cut away view of a seal assembly for a speaker transducer in accordance with a preferred embodiment of the invention.

Referring now to FIG. 3, there is shown a side cut away view 300 of the seal assembly for the speaker transducer 104, in accordance with a preferred embodiment of the invention. The chassis 102 supports the transducer 104 and seal assembly on a support ledge 202. Disposed on the support ledge 202 is the first compliant member 204, which is situated between the support ledge 202, and the speaker basket 206. Disposed on the opposing side of the speaker basket 206 is the second compliant member 208. On top of the second compliant member 208 sits the seal member 108. In the preferred embodiment, the seal member 108 is retained by a retaining ledge 302 formed on an inside of the seal member. The retaining ledge 302 prevents the seal member 208 from moving outward, away from the center of the speaker transducer 104. The retaining ledge 302 is disposed in proximity to the second compliant member 208, which may be retained by an outer lip 303 of the speaker basket 206. The compliant member or members can be affixed with adhesive, according to design preference. To facilitate assembly into the housing, the seal member 108 has a chamfered edge 304. The chamfered edge reduces the tendency of the seal member 108 to get caught on features in the housing or an edge of the housing upon assembly. As the assembly is inserted into the housing, the chamfered edge 304 makes contact with the housing, which causes compression in the direction of axis 306.

Figure 4:
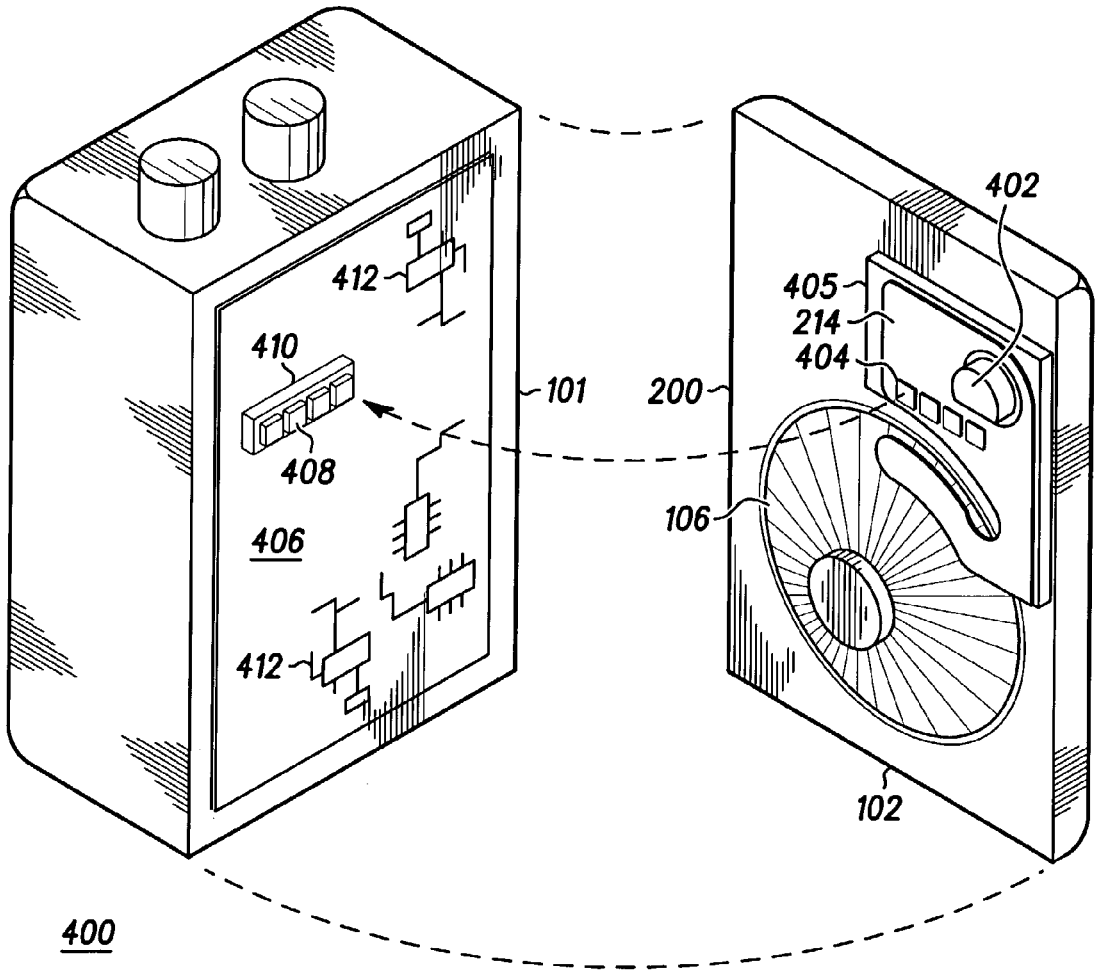
FIG. 4 shows an isometric view of a radio assemb in accordance with one embodiment of the invention.

Referring now to FIG. 4, there is shown an isometric view of a partial radio assembly 400 in accordance with an embodiment of the present invention. In this embodiment, it is demonstrated how the assembly of the present invention allows for the transducers 104, 106 to be mounted on different planes. Radio assembly 400 includes transducer assembly 200 and radio sub-assembly 101 respectively. The transducer assembly 200 shows the reverse side of the transducer assembly of FIG. 2 assembled together in accordance with the present invention. The transducer assembly 200 shows the chassis 102, speaker transducer 104, flexible circuit board 214, and further includes pad 402 and transducer electrical contacts 404 disposed on the flexible circuit board. In this embodiment, there is included a support ledge 405 protruding from the chassis 102 which supports the flex 214 and allows the microphone transducer 106 to be on a different plane that the speaker transducer 104. Thus, the speaker transducer 104 and microphone transducer 106 are on different planes.

The radio sub-assembly 101 includes a printed circuit board (pcb) 406 having radio circuitry 412 disposed thereon and radio electrical interconnect contacts 408 aligned within a support block 410.

In accordance with a preferred embodiment, the microphone transducer 106 is coupled to the speaker transducer 104 via the flexible circuit board 214. When the transducer assembly 200 is coupled to the radio sub-assembly 101, the transducer electrical contacts 404 align and make contact with the radio electrical interconnect contacts 408, thereby providing electrical connection between the transducers 104, 106 and the circuit board 406. Once assembled, pad 402 is compressed against the circuit board 406, thus providing increased support and retention of the microphone transducer 106 within the radio even if the microphone is on a different plane than the speaker transducer. The ability to assemble the transducers on different planes provides improved manufacturing and design versatility.

The partial radio assembly 400 shown in FIG. 4 demonstrates how the speaker transducer 104 and microphone transducer 106 are able to float independently of each other and thus be assembled on different planes. The use of the term float as used herein means that each seal assembly compresses against the housing independently. Thus, as the transducer sub-assembly 200 is slid into the housing 103, the microphone transducer and speaker transducer each compress against the housing independently forming separate seals.

Once assembled, transducer assembly 200 and radio sub-assembly 101 form the radio subassembly as seen in FIG. 1, which slides into the cup-style housing 103 to form the completed radio 100. Accordingly, there has been provided a transducer assembly apparatus that provides an improved acoustical seal through the use of a compliant member coupled to the transducer and a substantially rigid member providing a seal between the chassis and the housing. The compliant member minimizes transmitted vibrations to the rest of the mechanics. The improved seal of the present invention facilitates assembly in cup-style housings in which there are two different (perpendicular) axis of assembly. The assembly of the present invention further facilitates the use of two independent transducers, allowing each of them to float on different planes independently of each other.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An apparatus providing an acoustic seal for a transducer, comprising:

a cup-style housing;

a sub-assembly, including:

a chassis having an aperture formed therein;

a compliant member coupled within the aperture for retaining the transducer; and a substantially rigid member coupled to the transducer, the substantially rigid member providing a seal between the chassis and the housing; another transducer and a flexible circuit board, wherein the flexible circuit board mechanically couples the transducer and the other transducer, and wherein the other transducer forms an independent acoustic seal with the housing by using another compliant member and another substantially rigid member, wherein the transducer and the other transducer are assembled on different planes; first and second grills formed in the cup-style housing; and wherein the sub-assembly's transducer and the other transducer comprises a speaker and a microphone, the sub-assembly being slideably insertable into the cup style housing such that the speaker and microphone align with the first and second audio grills.

2. The apparatus of claim 1, wherein the substantially rigid member is formed having a chamfered surface.

3. The apparatus of claim 1, further comprising adhesive disposed on the substantially rigid member.

4. The apparatus of claim 1, wherein the sub-assembly is slideably insertable into the cup style housing through a first assembly axis, the substantially rigid member forming a seal between the housing and chassis through a second assembly axis.

5. The acoustical assembly of claim 4, wherein the first assembly axis and the second assembly axis are substantially perpendicular to each other.

6. The apparatus of claim 5, wherein the sub-assembly slideably inserts into the cup-style housing such that the chassis, the substantially rigid member, and the compliant member compressibly align and form a seal about the transducer.

* * * * *